US006774802B2

(12) United States Patent
Bachinski et al.

(10) Patent No.: US 6,774,802 B2
(45) Date of Patent: Aug. 10, 2004

(54) DETECTION AND AIR EVACUATION SYSTEM

(75) Inventors: Thomas J. Bachinski, Lakeville, MN (US); David J. Oja, Burnsville, MN (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/103,159

(22) Filed: Mar. 20, 2002

(65) Prior Publication Data

US 2003/0201900 A1 Oct. 30, 2003

(51) Int. Cl.[7] ..... G08B 17/10

(52) U.S. Cl. ..... 340/632; 340/628; 340/630; 340/539.1; 340/539.26

(58) Field of Search ..... 340/628, 630, 340/632, 629, 539, 852.69, 825.72, 539.1, 539.26

(56) References Cited

U.S. PATENT DOCUMENTS

| | | | | |
|---|---|---|---|---|
| 4,845,486 A | | 7/1989 | Knight et al. | |
| 5,132,968 A | | 7/1992 | Cephus | |
| 5,280,273 A | | 1/1994 | Goldstein | |
| 5,319,698 A | | 6/1994 | Glidewell et al. | |
| 5,464,369 A | | 11/1995 | Federspiel | |
| 5,576,739 A | | 11/1996 | Murphy | |
| 5,889,468 A | | 3/1999 | Banga | |
| 5,892,690 A | | 4/1999 | Boatman et al. | |
| 5,936,532 A | | 8/1999 | Peralta | |
| 5,955,031 A | | 9/1999 | King, Jr. | |
| 5,971,067 A | | 10/1999 | Rayburn et al. | |
| 5,999,094 A | | 12/1999 | Nilssen | |
| 6,036,595 A | * | 3/2000 | Vole | 454/239 |
| 6,097,288 A | | 8/2000 | Koeppe, Jr. | |
| 6,110,038 A | | 8/2000 | Stern | |
| 6,179,326 B1 | * | 1/2001 | Breed et al. | 280/735 |
| 6,247,919 B1 | | 6/2001 | Welz, Jr. et al. | |
| 6,380,852 B1 | * | 4/2002 | Hartman et al. | 340/521 |
| 6,494,777 B1 | | 12/2002 | Chiang | |
| 2002/0183001 A1 | | 12/2002 | Holter et al. | |

FOREIGN PATENT DOCUMENTS

| | | |
|---|---|---|
| JP | 3-152328 | 6/1991 |

* cited by examiner

*Primary Examiner*—Julie Lieu
(74) *Attorney, Agent, or Firm*—Merchant & Gould P.C.

(57) ABSTRACT

Described is a system for detecting toxic levels of a contaminate in a monitored area. The system controls an air evacuation device that operates in response to the detection of a predetermined level of contamination. The system also acts to deactivate appliances that may be contributing to the level of contamination. In addition, the system alerts local emergency units with a pre-recorded message of the emergency situation.

37 Claims, 2 Drawing Sheets

DETECTION AND AIR EVACUATION SYSTEM

TECHNICAL FIELD

The principles disclosed relate to the detection of a toxic particulate or gas. More particularly, this disclosure concerns a detection and air evacuation system for use in the home that responds to the presence of a toxic contaminate by deactivating and activating devices of the household to decrease the amount of particulate or gas contamination.

BACKGROUND

Toxic airborne contaminates are difficult to detect, especially when such contaminates are odorless or present at levels within the home or office that cannot be smelled or are masked by other odors. Carbon monoxide is one such contaminate that is odorless and colorless, and has no warning of its presence. This particular contaminate is a serious hazard because carbon monoxide has strong attraction to hemoglobin. Oxygen in the lungs, which normally combines with hemoglobin, is replaced by carbon monoxide when present in the lungs. In high enough concentration, hemoglobin that has combined with carbon monoxide can cause poisoning and death in some cases.

The threat of other types of toxic contamination also exists within homes and office buildings. For example, smoke and smoke particulates, propane gas, methane gas, radon gas, and other toxic particulates or gases can create hazardous situation for occupants.

Recent gas and particulate sensing devices have come into the market to warn consumers of the presence of high levels of contaminates. These devices typically comprise a sensing material or device and an alarm or warning mechanism. While these devices warn of existing dangerous conditions, most devices do not react to assist in reducing or remedying the dangerous contamination condition.

While precautions can be taken to minimize the possibility of poisoning, accidental or inadvertent contamination does occur. In general, improvement has been sought with respect to detection and alarm systems, generally to provide a reliable system of detection that better safeguards against the dangerous effects of existing toxic contaminates.

SUMMARY

One aspect of the present invention relates to a system that detects a toxic contaminate in the home and activates several systems.

Another aspect of the present invention relates to a system that activates an air ventilation system by accessing clear environmental air upon detection of a predetermined condition within a home.

Yet another aspect of the present invention relates to a system that detects a toxic contaminate within the home and deactivates appliances in response to the contamination.

DETAILED DESCRIPTION

With reference now to the various figures in which identical elements are numbered identically throughout, a description of various exemplary aspects of the present invention will now be provided.

I. Overall Operation

Figure 1:
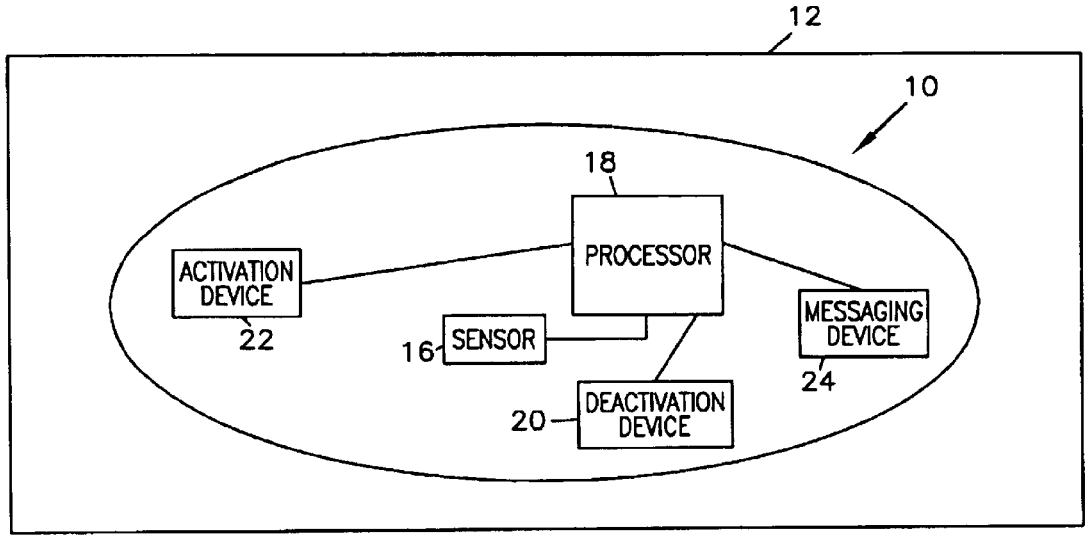
FIG. 1 is a schematic of one embodiment of the detection and evacuation system used in a centralized configuration in accordance with the principles disclosed.

A detector and air evacuation system 10 is schematically illustrated in FIG. 1. The system 10 is installed within a building and monitors the air quality of a monitored area 12. In the present disclosure, the building in which the operation of the system 10 is described is a home. It is contemplated that the system may also be installed in other types of structures, including an office building, commercial building, factory, barn, garage, or any other building where toxic contamination can occur.

In the illustrated embodiment of FIG. 1, a sensor assembly 16 of the system 10 is located generally within a central region the monitored area 12. The sensor assembly may also be located outward from the central region, for example, along the perimeter of the monitored area. The sensor assembly includes a detection unit or detection mechanism that operates to detect contamination of ambient air within the monitored area 12.

Figure 2:
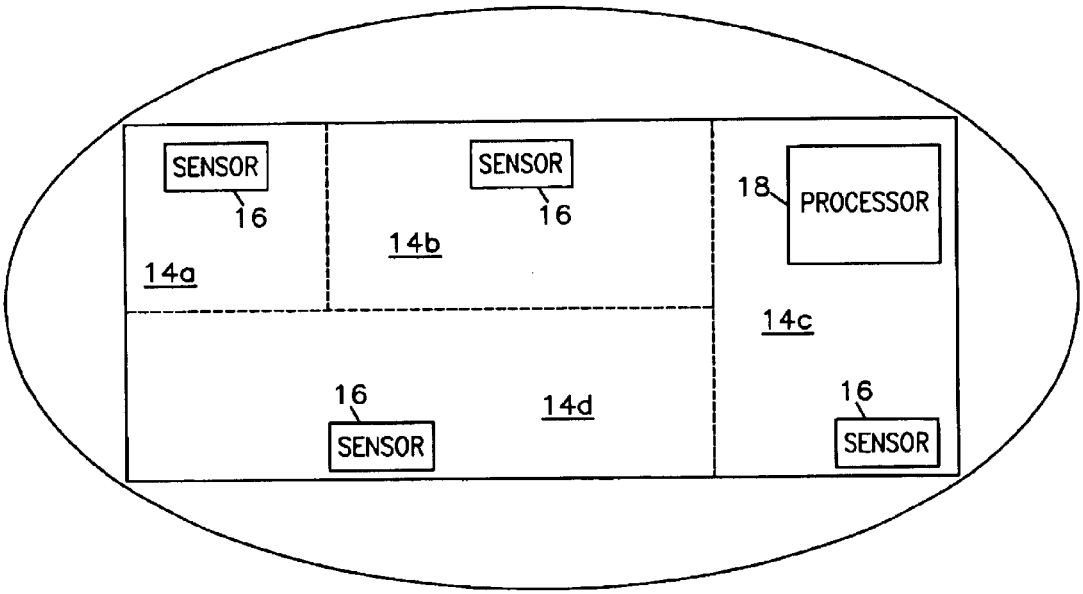
FIG. 2 is a schematic of another embodiment of the detection and evacuation system used in a zone configuration in accordance with the principles disclosed.

As shown in FIG. 2, the system 10 may include a plurality of sensor assemblies 16 placed at various locations within the monitored area 12. In particular, the sensor assemblies 16 may be placed at strategic locations within zones 14*a*–14*d* (represented by dashed lines). The zones may comprise either a plurality of discrete monitored areas or overlapping monitored areas. The zones may further be, for example, rooms of a home within which the sensor assemblies are strategically located adjacent specific appliances such as a fireplace, a hot water heater, or a furnace. What is meant by strategically located is that the sensor assembly is selectively placed so that contamination is more quickly detected. Also, the selectively placed sensor assembly can be used to isolate or indicate the source of contamination by the sensor's immediate locality adjacent the specific appliance. Thus, strategic placement offers safety advantages by reducing the amount of toxic contaminate exposure to occupants by immediate detection and notification thereof, and by assisting in locating the contaminate source.

The system 10 includes a central processor 18 located within an electronic communication range of each sensor assembly. The central processor 18 generally includes a receiving device for communicating with each sensor assembly 16. The receiving device may include a device that receives wireless transmissions or a device that involves hardwire connections. The central processor also includes a controller unit or other programmable logic control device known to those of skill in the art for processing information or signals received from the senor assemblies. The central processor 18 may be an integral or single unit construction with one of the sensor assemblies, or may be a separate unit located a distance from all of the sensor assemblies.

In addition to communicating with each sensor assembly 16, the central processor 18 similarly includes communication devices or transmitters for communicating signals to other safety devices of the system. Preferably, the other safety devices in communication with the central processor 18 include: a deactivation device 20, an activation device 22 and a messaging device 24 (shown schematically in FIGS. 1 and 3). It is noted that FIG. 2 is a representation of the locations of sensor assemblies with respect to the central processor 18; the other safety devices, while important to the overall operation of the system, have not been illustrated in FIG. 2 for purposes of clarity only.

II. Detection Operation

The present system is used to detect toxic contaminates within the ambient air of a home or office. Toxic contaminates may be in form of airborne particulates or gas. Further toxic contaminates may be any airborne particulate or gas that is dangerous, hazardous, or not dangerous or hazardous but unwanted or undesirable at certain levels in the ambient air. For purposes of explanatory clarity only, the remainder of this disclosure will describe one embodiment of the system proving carbon monoxide gas detection; although incorporating alternative detection systems will enable the system to monitor ambient air for other toxic contaminates. Specifically, it is contemplated that the principals of the present system, as will be described, may be used to monitor smoke, propane gas, methane gas, radon gas, or other toxic contaminates.

Carbon monoxide is a byproduct of incomplete combustion. Carbon monoxide sources include automobile exhaust fumes, furnaces, kitchen gas ranges, water heaters, fireplaces, charcoal grills, and small gasoline engine operated equipment. With concern for energy efficiency, homes and offices are built tighter, having more insulation, caulking, insulating window films and weather stripping. The energy efficient construction of some homes and offices, however, does not provide adequate fresh airflow to dissipate would-be amounts of carbon monoxide or other contaminates. Thus, the danger of toxic contamination is becoming increasingly apparent in such well-sealed homes and office buildings.

Preferably, one or more sensor assemblies 16 are strategically positioned in the home to ensure conditions within the home are properly monitored. The detection mechanism of each sensor assembly 16 analyzes sampled ambient air conditions to determine if an emergency situation exists. The sensor assembly 16 also includes a communication device, such as a sensor signal transmitter or emitter, which issues or emits a first emergency signal indicative of the analyzed or sensed emergency condition.

The carbon monoxide detection mechanism of the sensor assembly 16 may include, for example, a light emitter and a light detector. In general, this type of detection mechanism operates by emitting a light from the emitter that passes through a sensor cell to the light detector. Changes in light characteristics, e.g. photon intensity or color (spectral shift in photon absorbance), exceeding a sensitivity threshold cause the sensor assembly to produce the first emergency signal. Any suitable light emitter and light detector known to those of skill in the art may be used. Typically a selected band of visible or infrared light is used. The light emitter may include, for example, a light emitter diode and the light detector may include, for example, a photo diode.

With regards to the sensitivity threshold or predetermined limit, the sensor assembly may be calibrated to respond to a particular contamination level. The carbon monoxide sensor assembly may be set relatively low (200–400 ppm) so as to detect the presence of carbon monoxide before any occupants of the home are aware of the carbon monoxide. Other particular contamination calibrations can be set. For example, the sensor assembly can be calibrated to respond when the concentration of carbon monoxide is 50 ppm for six hours, 200 ppm for one half hour, or 400 ppm at any time.

When the sensor assembly 16 senses that the sensitivity threshold has been exceeded, the first emergency signal generated or produced by the sensor assembly 16 is transmitted to the central processor 18. The sensor assembly 16 may also include an audible localized alarm that sounds in response to the exceeded sensitivity threshold.

Figure 3:
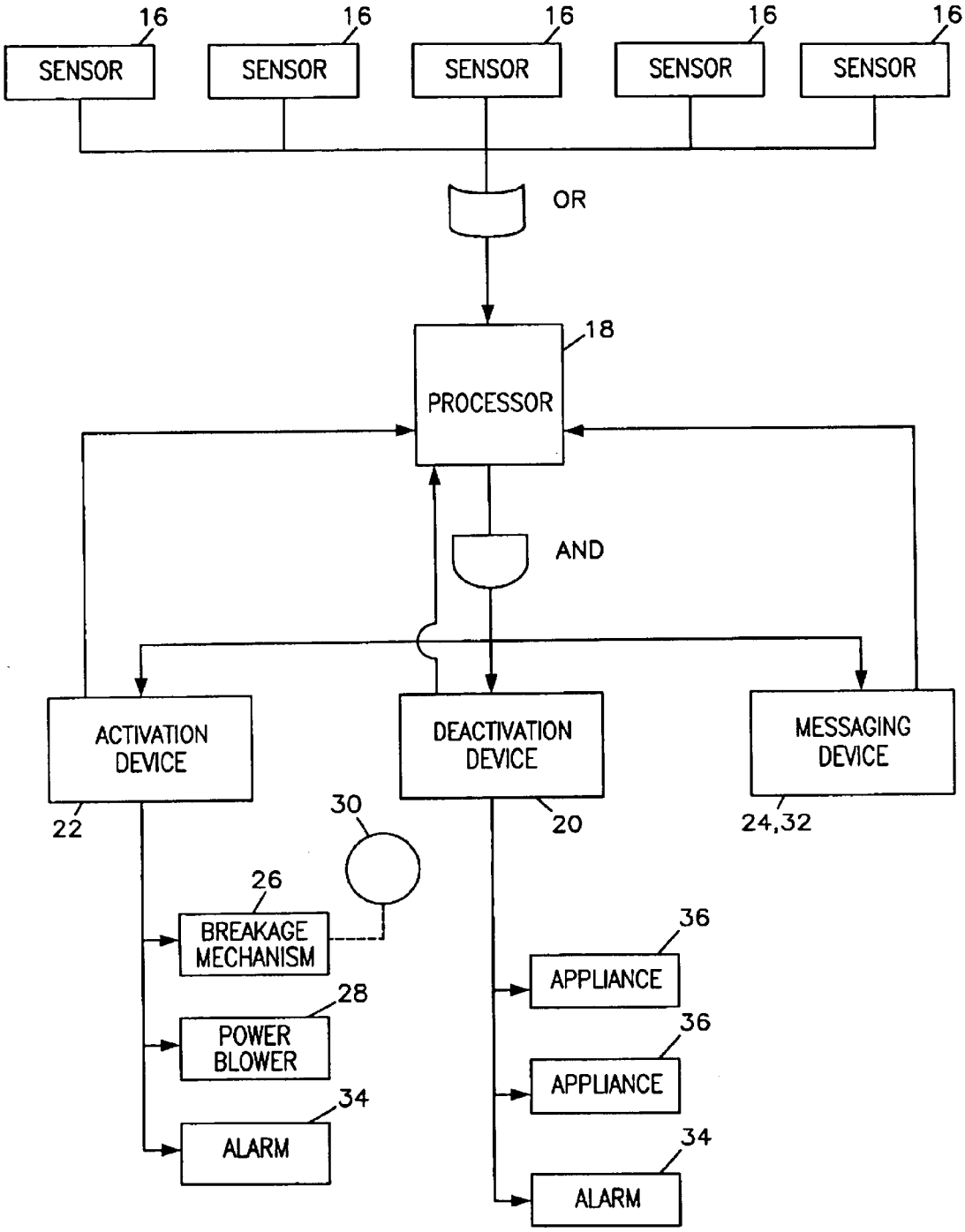
FIG. 3 is a block diagram of the various connections of the detection and evacuation system in accordance with the principles disclosed.

With reference now to FIG. 3, an OR input gate of the central processor 18 is shown having multiple inputs, specifically, the communications from the carbon monoxide sensor assemblies 16. This configuration provides for activation of the system 10 upon receiving a first emergency signal from any one of the sensor assemblies. As described above, the first emergency signal is one that is generated by a sensor assembly upon detecting gas contamination of the ambient air in excess of a pre-determined limit within the monitored area or zone of the home.

The central processor preferably includes an AND output gate; specifically, the central processor 18 is preferably designed such that each of the safety devices respond to any one first emergency signal received from a sensor assembly. The safety devices of the present system 10, including the deactivation device 20, the activation device 22 and the messaging device 24, operate to decrease the level of gas contamination and notify emergency personnel of the emergency situation.

III. Deactivation Operation

Upon receipt of a first emergency signal from any one of the sensor assemblies 16, the control processor 18 transmits a second emergency signal to energize a number of safety devices including one or more deactivation devices 20.

The deactivation device 20 includes a receiver to receive the second emergency signal from the control processor 18. The deactivation device generally operates to deactivate a particular appliance 36 that may be contributing to the level of gas contamination. In particular, the deactivation device 20 includes a shut-off mechanism that operates to shut down or disable a gas-operated appliance 36 so that any possible carbon monoxide leakage occurring from operation of that appliance is suspended.

In one embodiment, the shut-off mechanism may include, for example, a solenoid valve of a valve assembly in fluid communication with a gas line that fuels the appliance. In another embodiment, the shut-off mechanism may include, for example, an electric contact switch that opens to turn the appliance off. In yet another alternative embodiment, the deactivation device may include mechanisms that operate to switch off the appliance and terminate gas flow to the appliance. The appliance may be, for example, a furnace, hot water heater, gas fireplace or gas stove, or kitchen stove. The appliance may also be appliances or equipment found in office buildings, factories, warehouses, garages, or the like. Further, the appliance 36 may be a non-gas operated appliance that an occupant desires to be deactivated in such contamination emergencies. It is contemplated that any number of deactivation devices may be used on any number of appliances within the home or building. For example, one deactivation device may be used to disable a number of appliances plumbed or wired accordingly, or a number of appliances may each correspond to one of the same number of deactivation devices.

The central processor 18 may be configured to transmit the second emergency signal to multiple deactivation devices so that all potentially leaking appliances are disabled and all possible sources of contamination are shut off. This type of configuration is preferred with systems comprising a centrally located sensor assembly 16.

In another configuration, the central processor 18 may be programmed to transmit the second emergency signal to only one or a select number of deactivation devices 20. In this arrangement, the central processor 18 is programmed to recognize an identifiable first emergency signal from a particular sensor assembly. The central processor 18 then responds by transmitting an identifiable second emergency signal to only a particular deactivation device, or a selected few deactivation devices, located proximate the possible source of contamination. In other words, the central processor 18 transmits a corresponding identifiable deactivation signal to deactivate a particular appliance located in the zone or area proximate the particular sensor assembly that detected the contamination. This configuration is preferably used with systems having a number of sensor assemblies with the monitored area of a home, such as that shown in FIG. 2.

The identifying configuration as just described, is advantageous in providing a home occupant or owner protection. For example, in the event that a sensor assembly 16 located in zone 14*c* of the monitored area 12 detects an exceeded limit of contamination, the central processor 18 may be programmed to respond by deactivating only a fireplace located proximate the alerted sensor assembly. By programming the central processor 18 of the system 10 to selectively respond to first emergency signals, the system 10 can, for example, maintain operation of a non-leaking furnace located in the basement of the home so that the home remains heated. This can be important for occupants living in climates that experience cold winters or in situations where the occupants or owners are on leave for an extended period of time.

The deactivation devices of the system 10 may also include a separate status signal transmitter configured or programmed to provide feedback indicating that the appliance has been shut off. Specifically, the status signal transmitter or program may communicate a confirmation signal to the central processor that in turn may, for example, illuminate an LED light on a display to inform the occupant of the deactivation occurrence. A series of LED lights corresponding to the deactivation devices may also be included to inform the occupant of which appliance or appliances were deactivated. A sound verification device or alarm, described in further detail hereinafter, may also be used in conjunction with the deactivation device to confirm the deactivation occurrence.

A reset switch to resume operation of the deactivated appliance and neutralize or shut down the response of the system 10 can be operatively located at either the central processor 18 or the deactivation devices 20. The reset switch may function to reset all safety devices to non-emergency operating status, or reset only a particular safety device upon which the reset switch is located.

IV. Activation Operation

Also upon receipt of a first emergency signal from any one of the sensor assemblies 16, the control processor 18 transmits a second emergency signal to energize a number of safety devices including one or more activation devices 22.

The activation device 22 includes a receiver to receive the second emergency signal from the control processor 18. In one embodiment, the activation device 22 energizes an air circulating system or air evacuation apparatus that operates to reduce the level of ambient air contamination in the home. Air evacuation is the evacuation of contaminated ambient air within the home so that overall ambient air contamination is reduced to a level below the pre-determined limit.

In the preferred embodiment air evacuation is accomplished in one of two ways. In one arrangement, the air evacuation apparatus operates to reduce the level of contamination by expelling the contaminated ambient air from within the home. In an alternative arrangement, the air evacuation apparatus operates to reduce the level of contamination by venting fresh air into the home. It is also contemplated that the activation device may energize an air evacuation apparatus that operates to reduce the level of contamination by both the aforementioned methods. Further, any number of activation devices may be used with any number of apparatuses that operate to reduce the level of contamination with the home.

The air evacuation apparatus of the present system 10 includes a breakage mechanism 26 and an air circulator or power blower assembly 28. The air evacuation apparatus works in conjunction with a barrier 30 installed within the home. The barrier may be installed within the monitored zone 12 of the home or a non-monitored area, provided the activation device 22 is in electronic communication with the central processor 18. In one arrangement, the barrier is installed within a bedroom of the home to assist in evacuating contaminated air and venting in fresh air in an area in which sleeping occupants may be located.

In one embodiment, the barrier 30 includes a frame structure surrounding a breakable surface. The frame structure is mountable to existing home or building framework or may be installed at the time of initial construction. The breakable surface of the barrier 30 may comprise, for example, a plastic layer or sheath construction. Other breakable surfaces that permit exposure of the ambient air to the outside environment by action of the breaking mechanism (hereafter described) may be used in accordance with the principles disclosed. Preferably the breakable surface has insulating characteristics to preserve the heating and cooling of the ambient air within the home when not used in an emergency situation.

The breakage mechanism 26 is designed to break the barrier 30 to assist in de-contaminating the home by accessing clear environmental air. In one embodiment, the breakage mechanism 26 includes a solenoid valve and a spring-loaded mechanism coupled to an impact member. The spring-loaded mechanism is actuated by the solenoid valve which is energized in response to receipt of the second emergency signal from the central processor 18. The breakage mechanism 26 is positioned adjacent the barrier 30 such that the travel of the solenoid corresponds to the travel necessary for the breakage mechanism to break through the barrier. The spring-loaded mechanism causes the impact member to impart a force upon the breakable surface. The force of the impact member fractures through or cuts open the breakable surface to expose the interior of the home to fresh outside air.

In another embodiment, the barrier includes a similar frame structure as previously described, having a pivoting plate or flap. In non-emergency situations, the plate or flap remains closed. Upon receipt of a second emergency signal from the control processor 18, a second type of breaking mechanism 26 may be actuated to open the flap or plate and expose the interior of the home to the fresh outside air. Other breakage mechanism designed to open or break a barrier to access environmental air may be used in accordance with the principles disclosed.

The air circulator or power blower assembly 28 of the air evacuation apparatus works in cooperation with the breakage mechanism 26. The power blower assembly 28 includes a fan and motor located proximate the barrier 30. The fan may be arranged to draw fresh air into the home or may be arranged to expel contaminated air from the home.

In an alternative arrangement, the fan of the power blower assembly may act as the breakage mechanism 26 to break the barrier 30 to expose the contaminated ambient air of the home to fresh outside air. It is contemplated that other blower arrangements designed to circulate air and assist in decreasing the amount of gas contamination within the home or building may be used in accordance with the principles disclosed.

Activation of the power blower assembly 28 may occur simultaneous with activation of the breakage mechanism 26, or may be programmed to activate a pre-determined period of time after the breakage mechanism has been activated.

The system 10 of the present disclosure may further include multiple air evacuation apparatuses and barrier structures. For instance, multiple power blower assemblies can be arranged such that some blower assemblies intake fresh air into the home and others expel contaminated air from the home. By selectively placing the power blower assemblies in the home, a fresh airflow that circulates throughout a major portion of the home can be created to quickly reduce the level of contamination. In addition, the multiple air evacuation arrangement balances the amount of air intake and air exhaust to increase air circulation efficiency.

Similar to the deactivation devices, the activation devices may also include a separate status signal transmitter configured or programmed to provide feedback indicating that the air evacuation has been activated. Specifically, the status signal transmitter or program may communicate a confirmation signal to the central processor 18 that in turn may, for example, illuminate an LED light to inform the occupant of the activation occurrence. A sound verification device or alarm, described in further detail hereinafter, may also be used in conjunction with the activation device to confirm the activation occurrence.

A reset switch to de-energize the activation device and neutralize or shut down the response of the system 10 can be operatively located at either the central processor 18 or the activation device 20. The reset switch may function to reset all safety devices to a non-emergency operating status, or reset only the air evacuation safety device upon which the reset switch is located.

V. Notification Operation

Another safety device that is activated or energized in response to a second emergency signal from the control processor 18 is a messaging unit 24. The messaging unit may include, for example, a telephone unit 32 connected to a telephone line and programmed to alert emergency personnel of the emergency situation. In the alternative, the telephone unit may include a cellular transmitter for contacting emergency personnel through cellular telephone networks. The telephone unit 32 is place at a location to receive the second emergency signal from the central processor. Upon receipt of the second emergency signal, the telephone unit 32 automatically dials a pre-programmed emergency number and plays a pre-recorded message informing the proper personnel, such as 911 personnel, of the existence of the emergency situation.

The telephone unit may be programmed to dial more than one number stored in a memory device to inform others of the danger, such as a neighbor or family member, in addition to 911 personnel. Also, it is contemplated that identifiable second emergency signals from the central processor 18 may operate to selectively dial a particular number to communicate a particular message corresponding to the specific sensor assembly that originated the first emergency signal. Thereby, recipients of the selected message will be better informed of the specific situation occurring within the home before arriving to provide assistance (e.g. which appliance is likely leaking or which zone is contaminated).

In addition, an alarm device 34 can be connected to the central processor 18 or any one of the deactivation devices 20, activation devices 22 or sensor assemblies 16 to warn persons in the vicinity of the dangerous situation. The alarm 34 may comprise any suitable audible or visible attention-getting device, such as a buzzer, chime, bell, flashing light, recorded message or the like. This device may also assist an occupant or emergency personnel in identifying or isolating the zone or appliance near which the contamination has been detected.

Although the above system has been described in use for detection of carbon monoxide, incorporating an appropriate sensor with the system in accordance to the principles disclosed will enable the system to monitor other gases or conditions. In particular, it is contemplated that the principles of the system disclosed may be used to monitor smoke, propane gas, motion light, temperature and water level of a home or building to determine if an emergency situation exits.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A detection and evacuation system, for use in a home, the system comprising:

a) at least one sensor assembly for detecting contamination of a contaminate in ambient air, the sensor assembly including a communication device that produces a first emergency signal upon determining the existence of a pre-determined level of toxic contamination;

b) a central processor, the central processor including:

i) a receiving device for receiving the first emergency signal from the communication device of the sensor assembly; and ii) at least one transmitter capable of transmitting a second emergency signal;

c) at least one deactivation device energized in response to the second emergency signal from the central processor transmitter, the deactivation device operating to suspend operation of an appliance;

d) at least one activation device energized in response to the second emergency signal from the central processor transmitter, the activation device operating to reduce the level of toxic contamination within the home; and (e) an air evacuation apparatus to assist in reducing the level of toxic contamination within the home, the air evacuation apparatus including a breakage mechanism, a barrier, and a blower, the activation device activating the breakage mechanism and the blower upon receipt of the second emergency signal from the central processor.

2. The system of claim 1, wherein the sensor assembly and the central processor form a single unit construction.

3. The system of claim 1, wherein the system includes a plurality of sensor assemblies, each of the sensors being in electronic communication with the central processor.

4. The system of claim 3, wherein one of each of the sensor assemblies is located proximate one of a plurality of appliances for isolated contamination detection.

5. The system of claim 4, wherein each of the plurality of appliances has a corresponding one of a plurality of deactivation devices to suspend operation of the appliance.

6. The system of claim 5, wherein the first emergency signal produced by each of the sensor assemblies is identifiable by the central processor to identify the sensor assembly from which the first emergency signal is produced.

7. The system of claim 6, wherein the second emergency signal of the central processor energizes only the deactivation device corresponding to the appliance proximately located to the sensor assembly that produced the first emergency signal.

8. The system of claim 1, wherein the deactivation device includes a shut-off mechanism, and wherein the first appliance is a gas-operated appliance, the shut-off mechanism operating to suspend gas flow to the gas-operated appliance.

9. The system of claim 1, further comprising:

a messaging unit energized in response to the second emergency signal from the central processor transmitter, the messaging unit operating to notify emergency personnel that the sensor assembly has detected the pre-determined level of toxic contamination.

10. The system of claim 9, wherein the messaging unit is a telephone unit capable of dialing an emergency number and playing a pre-recorded message upon receipt of the second emergency signal from the central processor.

11. The system of claim 1, further comprising:

means for alerting emergency personnel upon receipt of the second emergency signal from the central monitoring means.

12. The system of claim 1, wherein the barrier is a plastic barrier designed to break upon impact of the breakage mechanism.

13. The system of claim 1, wherein the blower expels contaminated air from the home.

14. The system of claim 1, wherein the blower vents non-contaminated air into the home.

15. The detection and evacuation system of claim 1, wherein the contaminate is a toxic gas.

16. The detection and evacuation system of claim 15, wherein the toxic gas is carbon monoxide.

17. A toxic contaminate detection system for monitoring conditions within a monitored area, the system comprising:

a) a plurality of sensor means positioned within the monitored area for analyzing ambient air conditions to determine if an emergency situation exists, each of the plurality of sensor means including:
   i) a sensor device that senses the ambient air conditions;
   ii) a detection unit for analyzing the ambient air conditions; and
   iii) a transmitter for transmitting a first emergency signal if the sensor device detects an amount of contaminates in the ambient air that exceeds a pre-determined level;

b) a central monitoring means, the central monitoring means including:
   i) a receiver for receiving the first emergency signal from any one of the plurality of sensor means;
   ii) a control unit for analyzing the first emergency signal and generating a second emergency signal upon determining the existence of an emergency situation; and
   iii) a transmitter for transmitting the second emergency signal;

c) means for activating an air evacuation device upon receipt of the second emergency signal from the central monitoring means, the means for activating the air evacuation device including:
   i) a receiver to receive the second emergency signal from said central monitoring means;
   ii) a breaking mechanism for breaking a barrier to evacuate the ambient air within the monitored area;
   iv) an air circulator for reducing the level of ambient air contamination in the monitored area;

d) means for deactivating an appliance upon receipt of the second emergency signal from the central monitoring means, the means for deactivating an appliance including:
   i) a receiver to receive the second emergency signal from the central monitoring means;
   ii) a mechanism for deactivating operation of the appliance; and e) means for alerting emergency personnel upon receipt of the second emergency signal from the central monitoring means, the means for alerting emergency personnel including:
   i) a receiver to receive the second emergency signal from the central monitoring means; and
   ii) a telephone device for automatically dialing emergency personnel with a pre-recorded message.

18. The toxic contaminate detection system of claim 17, wherein the central monitoring means further includes a display for indicating which of the plurality of sensor means has detected the amount of contaminates in the ambient air exceeding the pre-determined level.

19. The toxic contaminate detection system of claim 17, wherein the means for deactivating the appliance further includes an alarm for indicating that an emergency situation exists.

20. The toxic contaminate detection system of claim 17, wherein the means for alerting emergency personnel includes a cellular transmitter for contacting emergency personnel through cellular telephone networks upon receipt of the second emergency signal from the central monitoring means.

21. The toxic contaminate detection 17, wherein the means for alerting emergency personnel further includes a memory unit for storing a plurality of telephone numbers of emergency personnel, the means for alerting emergency personnel being capable of analyzing the second emergency signal received to select one of the plurality of telephone numbers.

22. The toxic contaminate detection system of claim 21, wherein said means for alerting emergency personnel is further capable of selecting one of a plurality of pre-recorded messages, each of the pre-recorded messages having information related to the detected ambient air contamination.

23. The toxic contaminate detection system claim 17, wherein the contaminate is a toxic gas.

24. The toxic contaminate detection system claim 23, wherein the toxic gas is carbon monoxide.

25. A building having a detection and evacuation system, the building comprising:

a) a barrier constructed within the building located between the inside of the building and the outside of the building;

b) the detection and evacuation system installed within the building, the detection and evacuation system including:
   i) a contamination monoxide sensor, the contamination sensor being capable of analyzing ambient air within the building and transmitting a signal upon detection of an amount of a contaminate that exceeds a pre-determined limit;
   ii) a breakage mechanism, the breakage mechanism being adapted to break the barrier to expose the ambient air inside the building to the outside of the building;
   iii) an air circulator, the air circulator including at least one fan reducing the level of contaminated ambient air;

iv) a shut-off device connected to an appliance, the shut-off valve being adapted to termination operation of and gas flow to the appliance; and v) a processor that electronically controls operation of the breakage mechanism, the air circulator, and the appliance shut-off device upon receipt of the signal from the sensor indicating that the amount of contaminate has exceeded the predetermined limit.

26. The building of claim 25, wherein the building is a home.

27. A method of detecting toxic contamination of ambient air within a home and evacuating the contaminated air from the home, the method comprising the steps of:

a) constructing a barrier within the home, the barrier being located between the inside of the home and the outside of the home; and b) installing a detection and evacuation system within the home, the system including:

i) a contaminate sensor, the contaminate sensor being capable of analyzing ambient air within the building and transmitting a first emergency signal upon detection of an amount of contaminate that exceeds a predetermined limit;

ii) a breakage mechanism, the breakage mechanism being adapted to break the barrier to expose the ambient air inside the home to the outside of the home;

iii) an air circulator, the air circulator including a blower for reducing the level of contaminated ambient air;

iv) a shut-off device adapted to termination operation of an appliance; and v) a processor that electronically controls operation of the breakage mechanism, the air circulator, and the appliance shut-off device upon receipt of the signal from the sensor indicating that the amount of contaminate has exceeded the predetermined limit.

28. The method of claim 27, further comprising the step of setting a threshold sensitivity of the sensor to adjust the pre-determined limit to a selected pre-determined limit.

29. The method of claim 27, further comprising the step of installing a messaging unit within the home wherein the processor further electronically controls the operation of the messaging unit, the messaging unit operating to dial an emergency number to notify emergency personnel that the amount of contaminate within the home has exceeded the predetermined limit.

30. The method of claim 27, further comprising the step of arranging the blower of the air circulator to draw fresh air into the home to reduce the level of contamination.

31. The method of claim 27, further comprising the step of arranging the blower of the air circulator to expel the contaminated air from the home to reduce the level of contamination.

32. The method of claim 27, wherein upon receiving the first emergency signal, the processor transmits a second emergency signal received by each of the breakage mechanism, the shut-off device, and the air circulator.

33. The method of claim 32, wherein upon receiving the second emergency signal, the shut-off device operates to terminate operation of the appliance by opening electrical connections at a switch.

34. The method of claim 32, wherein upon receiving the second emergency signal, the shut-off device operates to terminate operation of the appliance by closing a valve assembly to cut gas flow to the appliance.

35. The method of claim 32, wherein upon receiving the second emergency signal, the breakage mechanism breaks the barrier and the air circulator operates to reduce the level of air contamination within the home.

36. The method of claim 27, wherein the contaminate is a toxic gas.

37. The method of claim 36, wherein the toxic gas is carbon monoxide.

* * * * *

UNITED STATES PATENT AND TRADEMARK OFFICE

CERTIFICATE OF CORRECTION

PATENT NO. : 6,774,802 B2
DATED : August 10, 2004
INVENTOR(S) : Bachinski et al.

It is certified that error appears in the above-identified patent and that said Letters Patent is hereby corrected as shown below:

Column 10,
Line 31, "detection 17," should read -- detection system of claim 17, --

Signed and Sealed this

Eighth Day of February, 2005

JON W. DUDAS
*Director of the United States Patent and Trademark Office*